United States Patent [19]

Suntola et al.

[11] 4,388,554

[45] Jun. 14, 1983

[54] ELECTROLUMINESCENT DISPLAY COMPONENT

[75] Inventors: Tuomo Suntola; Jorma O. Antson, both of Espoo, Finland

[73] Assignee: Ou Lohja Ab, Virkkala, Finland

[21] Appl. No.: 272,787

[22] Filed: Jun. 11, 1981

[30] Foreign Application Priority Data

Aug. 20, 1980 [FI] Finland ..... 802628

[51] Int. Cl.[3] ..... H01J 1/62

[52] U.S. Cl. ..... 313/505

[58] Field of Search ..... 313/483, 491, 505

[56] References Cited

U.S. PATENT DOCUMENTS 2,932,770 4/1960 Livingston ..... 313/505 X 3,631,286 12/1971 Anderson et al. ..... 313/505

*Primary Examiner*—Palmer C. Demeo

*Assistant Examiner*—Sandra L. O'Shea

*Attorney, Agent, or Firm*—Fitzpatrick, Cella, Harper & Scinto

[57] ABSTRACT

Disclosed herein is an electroluminescent display component, which may be provided as a unified, large-scale device mounted on a substrate. Electroluminescent material is sandwiched between two electrodes, each of which may be formed in spaced lines, perpendicular to the lines of the other electrode, to form a matrix. At each portion wherein the electrodes are disposed in opposition to each other, each electrode is formed with elongated parallel gaps, divergent from the gaps of the opposed electrode, thus providing a screen effect and minimizing the unified areas at which the electrodes are opposed to each other.

4 Claims, 2 Drawing Figures

ELECTROLUMINESCENT DISPLAY COMPONENT

BACKGROUND OF THE INVENTION

Thin-film electroluminiscent display components, which are in themselves known (cf., e.g., U.S. Pat. No. 3,560,784), are in principle also suitable for large-area applications, since the thin films can be readily processed onto substrates of several square decimeters. In practice, however, problems have been encountered in attempting to produce display elements of a large area.

In this regard, all thin films and thin-film components, produced in accordance with practical manufacturing processes, embody defects such as structural defects, holes, inhomogeneities, and impurities, etc. Such defects are often detected in connection with the basic testing of the component, but some remain undetected until later when the component is subjected to various environmental and operational strains. The nature of the defects vary so that some become evident under a slight strain, while others do not become a problem until the film is subjected to a severe strain. In connection with strain tests, one also must consider the frequency of defects per unit of area, or the yield of components after the performed tests. Typical tests are voltage-endurance tests, tests at an elevated temperature, humidity tests, sevice-life tests, and accelerated service-life tests, etc.

When these same techniques are applied to large-scale thin-film display components, however, it has been noticed that a unified large area of a display element is in itself an additional strain for the whole component, in which case there is an unacceptable number of defects (i.e. the yield is lower).

Moreover, a unified large-area display element ($>1$ $cm^2$) also gives rise to certain drawbacks which are difficult to overcome. Specifically, due to the capacitance between opposed electrodes, energy is stored in the display element sufficient to destroy the entire element if a weak point is encountered. Also, the series resistance (the resistance of the continuous transparent conductor) to a possible defective point is low, so that the current may increase to a destructively high level on an instantaneous disruption. Along these same lines the series resistance between the power source proper and the display element does not prevent destruction (does not limit the current), because the capacitance of the display element itself supplies sufficient destructive energy. Furthermore, inhomogeneities in a large-area display element, may cause heat generation at different parts of the element. Thus, hot points may be produced, which may result in destruction of the element as a result of a so-called thermal surge.

SUMMARY OF THE INVENTION

The object of the present invention is to eliminate the above drawbacks and to provide a large-area electroluminescent display component of an entirely new type. The invention is based on the idea that by rasterizing the electrodes facing each other on opposite sides of the electroluminescent layer, in a suitable way, it is possible to increase the redundancy of the component and, thereby, the yield of components. More specifically, the display component in accordance with the invention may be characterized, for example, as including a large scale glass substrate having a film type electrode thereon, and having an electroluminescent layer and a surface electrode disposed in that order on the bottom electrode. The respective electrodes are arranged in a raster-like configuration at all portions where they are disposed in opposition to each other. In this regard each electrode, at such opposed areas, is provided with elongated gaps arranged divergently with respect to the gaps of the other electrode. By means of the invention, considerable advantages are achieved, in that the raster-like electrode formation spreads heat more uniformly over the entire area of the element and thereby alleviates the above-described detrimental effects resulting from a unified large area.

The invention will be described below in more detail with the aid of an exemplifying embodiment and in accordance with the attached drawing.

DESCRIPTION OF A PREFERRED EMBODIMENT

Figure 2:
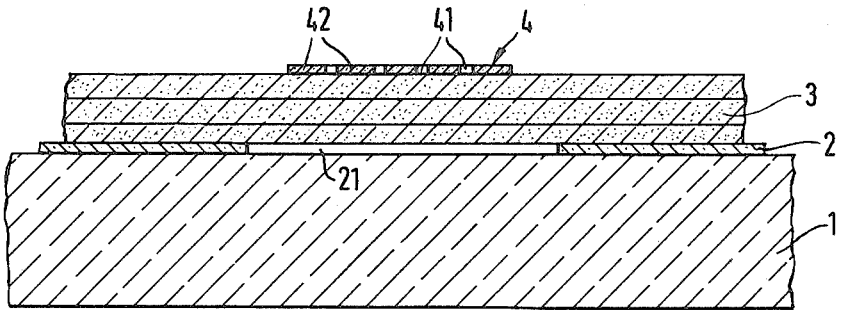
FIG. 2 shows a cross-section taken along line A—A of FIG. 1.

The construction in accordance with the drawing comprises a transparent base layer or substrate 1, which may be made of glass, and a film-type bottom electrode 2 fitted on the substrate. Several such electrodes may be arranged as strips, side by side, with predetermined spaces therebetween. The bottom electrode 2 is formed of a transparent material, and an electroluminescent layer 3 is disposed over the bottom electrodes. As illustrated in FIG. 2, the electroluminescent layer may consist of several component layers, as is known in the art. Finally, a film-type surface electrode 4 is disposed on the electroluminescent layer 3, it being understood that, as in the case of the bottom electrode, several such surface electrodes may be placed side by side as lines having spaces therebetween. As shown, when a plurality of each of such electrodes are arranged in lines they are preferably disposed perpendicularly to each other, thereby defining a display matrix.

Figure 1:
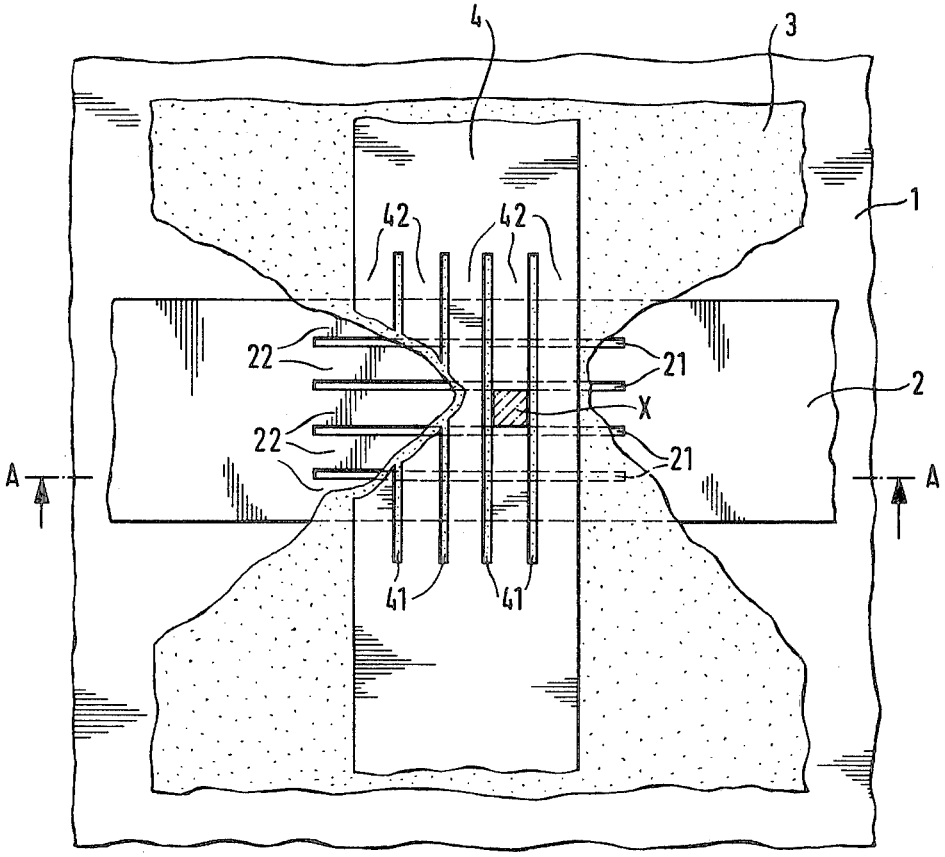
FIG. 1 shows the electrode construction of a display component in accordance with the invention as viewed from the top and partly in section.

Both of the bottom and surface electrodes, 2 and 4, are provided with elongated gaps 21 and 41, at all portions wherein they are opposed to each other, thereby defining thin strips of electrodes 22 and 42. Accordingly, as is shown in FIG. 1, a screen or sub-matrix is formed by the transverse conductor strips 22 and 42 at the desired position of a display element. Outside the element, the transparent electrodes 2 and 4 are unified relatively wide conductive members.

In the raster-like construction, as described above, the resistance at any point of defect X (FIG. 1) is high, due to the narrow extent of the strip 42. This resistance operates efficiently as a series resistance limiting the current, and the energy stored in the capacitance of a display element can be discharged only through the relatively long orthogonal strips 42 and 22 along a route of a high resistance at the defect point X.

The voltage (field strength) at the defect point X decreases immediately if the current tends to increase, because part of the voltage remains on the series resistances consisting of the transparent parts of the electrode which connects the defect point X to the rest of the display element. If, however, the current is strong enough to destroy the defect point X, the resultant permanent defect in the display element would be restricted to the small square inside which the defect point X is placed in the screen formed by the bottom electrode 2 and by the surface electrode 4. The current supply connection to the neighboring squares is, however, maintained even if the strip 22 in the bottom electrode 2 and the strip 42 in the surface electrode are burned out to the edges of the defect point X. Of course, the supply then takes place along the other, intact strips, both in the bottom electrode and in the surface electrode. Thus, the destruction is relatively harmlessly restricted to the small sub-element X, and the larger element, the display element proper, is still completely capable of operation.

Particularly, in a display module of 7×5 points (e.g., a display of alpha-numeric marks), each of the resultant 35 "points" may have an area of 5×5 $mm^2$ and is, in accordance with FIG. 1, rasterized into 5×5 strips so that a screen is produced having 25 small squares. In the case of a thin-film construction in which ITO (Indium Tin Oxide) films are used as the transparent electrodes and $Al_2O_3$/ZnS:Mn/$Al_2O_3$ films as the electroluminescent structure, it has been possible to ascertain that both the yield and the reliability of the components have been improved to a considerable extent by means of the construction in accordance with the invention. Even in the case in which a local point of destruction becomes evident, such as when an ITO conductor functions so that it is burned out up to the edges of the destroyed square, the defect may be ignored and the rest of the component (display element) operates normally thus providing a fuse effect.

As to several minor modifications of the abovedescribed preferred embodiment, it is to be understood that it is not necessary for both of the electrodes to be transparent, and that such electrodes may be disposed diagonally in relation to one another. In this regard, the directions of the gaps 21 and 41 may also differ from the directions of the electrodes 2 and 4.

With respect to the dimensions of the various elements of the display component, it has been found that the widths of the electrodes 2 and 4 may be 6 to 100 mm, while each electrode may have a thickness of about 40 nm; the widths of the gaps 21 and 41 may be 0.05 to 1.0 mm; and the thickness of the electroluminescent layer 3 may be about 800 nm.

What is claimed is:

1. An improved electroluminescent display component comprising a substrate having successive layers disposed thereon, including a film-type first electrode, an electroluminescent layer, and a second film-type electrode, the improvement comprising an arrangement of said first and second electrodes wherein opposed areas of said respective electrodes are divided into strips by means of elongated gaps disposed side by side over the extent of such opposed areas of each said first and second electrodes, said gaps being arranged in said first electrode in a diverging relationship with respect to the said gaps in said second electrode.

2. An electroluminescent display component as set forth in claim 1 wherein said first and second electrodes each comprises separate spaced lines, together forming a matrix which defines a pattern of separate display elements, each element being formed by an area of the electroluminescent layer which is sandwiched between opposed areas of said first and second electrodes, and wherein a plurality of said gaps are provided in each of said electrodes at each of said display elements.

3. An electroluminescent display component as set forth in claim 2 wherein the opposed lines are substantially perpendicular to each other and wherein the gaps are arranged substantially in the longitudinal direction of the lines such that the gaps, as well as the strips between them, in opposed electrode layers are substantially prependicular to each other.

4. An electroluminescent display component as set forth in claim 3 wherein the lengths of said gaps in each said electrode line are longer than the widths of said lines.

* * * * *